US009366991B2

(12) United States Patent
Fukamachi et al.

(10) Patent No.: US 9,366,991 B2
(45) Date of Patent: Jun. 14, 2016

(54) DEVELOPING CARTRIDGE HAVING A HOUSING FEATURING CLAWS TO ENGAGE A BEARING UNIT FOR A DEVELOPING ROLLER

(71) Applicant: Brother Kogyo Kabushiki Kaisha, Nagoya-shi, Aichi-ken (JP)

(72) Inventors: Yasuo Fukamachi, Nagoya (JP); Hideshi Nishiyama, Owariasahi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,263

(22) Filed: Jan. 9, 2015

(65) Prior Publication Data

US 2015/0117908 A1 Apr. 30, 2015

Related U.S. Application Data

(63) Continuation of application No. 13/431,741, filed on Mar. 27, 2012, now Pat. No. 8,942,594.

(30) Foreign Application Priority Data

Jun. 10, 2011 (JP) ..... 2011-129977

(51) Int. Cl.
*G03G 15/08* (2006.01)
*G03G 21/16* (2006.01)
*G03G 21/18* (2006.01)

(52) U.S. Cl.
CPC ..... *G03G 15/0865* (2013.01); *G03G 15/0896* (2013.01); *G03G 21/1647* (2013.01); *G03G 21/1857* (2013.01)

(58) Field of Classification Search
CPC ..... G03G 21/1857; G03G 21/1864; G03G 21/1647; G03G 15/0865; G03G 15/0896
USPC ..... 399/111, 119
See application file for complete search history.

(56) References Cited

U.S. PATENT DOCUMENTS 5,832,345 A 11/1998 Damji et al.
6,097,909 A 8/2000 Watanabe et al.
(Continued)

FOREIGN PATENT DOCUMENTS

CN 1598709 A 3/2005
JP H05-19550 A 1/1993
(Continued)

OTHER PUBLICATIONS

JP Office Action mailed Apr. 23, 2013, JP Appln. 2011-129977, English translation.
(Continued)

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

A developing cartridge is provided for use with an image forming apparatus and may include a housing, a developing roller rotatably provided in the housing, and a developing roller gear configured to rotate integrally with the developing roller. Further, the developing cartridge can include a driving input gear configured to receive an external driving force and apply the received driving force to the developing roller gear. The driving input gear can be meshed with the developing roller gear or an intermediate gear can be provided to mesh with the developing roller gear and the driving input gear. Such an intermediate gear can be configured to apply the received driving force to the developing roller gear. Also, the developing cartridge can include a receiving member which is disposed between the housing and the developing roller gear and between the housing and the driving input gear.

7 Claims, 10 Drawing Sheets

(56) References Cited

U.S. PATENT DOCUMENTS

| | | | | |
|---|---|---|---|---|
| 6,349,189 | B1 | 2/2002 | Jeon | |
| 6,816,692 | B1 * | 11/2004 | Kerley | G03G 15/0896 399/119 |
| 6,823,160 | B2 | 11/2004 | Okabe | |
| 7,027,756 | B2 * | 4/2006 | Hoshi | G03G 21/181 399/111 |
| 7,076,190 | B2 | 7/2006 | Jeon | |
| 7,330,681 | B2 | 2/2008 | Okamoto | |
| 7,627,262 | B2 | 12/2009 | Omura et al. | |
| 2003/0185594 | A1 | 10/2003 | Okabe | |
| 2005/0063733 | A1 | 3/2005 | Jeon | |
| 2006/0160381 | A1 | 7/2006 | Omura et al. | |
| 2008/0223173 | A1 | 9/2008 | Ishikawa | |
| 2009/0269085 | A1 | 10/2009 | Ukai | |
| 2009/0317134 | A1 | 12/2009 | Miyabe et al. | |
| 2010/0142993 | A1 | 6/2010 | Shiraki et al. | |
| 2011/0236051 | A1 * | 9/2011 | Kato | G03G 15/0832 399/90 |

FOREIGN PATENT DOCUMENTS

| | | | |
|---|---|---|---|
| JP | H10-20742 | A | 1/1998 |
| JP | H10-252864 | A | 9/1998 |
| JP | H11-219090 | A | 8/1999 |
| JP | 2002-328499 | A | 11/2002 |
| JP | 2003-295614 | A | 10/2003 |
| JP | 2005-092223 | A | 4/2005 |
| JP | 2006-154257 | A | 6/2006 |
| JP | 2007-057886 | A | 3/2007 |
| JP | 2010-134330 | A | 6/2010 |

OTHER PUBLICATIONS

CN Office Action mailed Nov. 4, 2013, CN Appln. 201210090786.1, English translation.

* cited by examiner

DEVELOPING CARTRIDGE HAVING A HOUSING FEATURING CLAWS TO ENGAGE A BEARING UNIT FOR A DEVELOPING ROLLER

CROSS REFERENCE TO RELATED APPLICATIONS

This application is a continuation of prior U.S. application Ser. No. 13/431,741, filed Mar. 27, 2012, which claims priority from Japanese Patent Application No. 2011-129977, filed on Jun. 10, 2011, the entire subject matter of which is incorporated herein by reference.

BACKGROUND

The disclosure relates to a developing cartridge which is provided with a developing roller and a gear which transmits driving force to the developing roller.

A developing cartridge provided with a developing roller, a developing roller gear which rotates integrally with the developing roller, and a driving input gear which applies driving force to the developing roller gear is known (for example, see Japanese Unexamined Patent Application Publication No. 2010-134330).

In particular, in this developing cartridge, rotation of the driving input gear is transmitted to the developing roller gear via a supply roller gear and an idle gear. In this configuration, the driving input gear and the idle gear are directly supported by a housing of the developing cartridge whereas the supply roller gear is fixed to an axis of a supply roller, and the axis of the supply roller is supported by a separate bearing which is fixed to the housing.

SUMMARY

However, in the above-described technology, since the driving input gear and a driven gear (for example, the supply roller gear) which receives driving force from the driving input gear are supported by separate members, the distance between an axis of the driving input gear and an axis of the driven gear is less precise, whereby uneven rotation of the gears is caused.

Therefore, a developing cartridge which is configured to position an axis of rotation of a developing roller and an axis of rotation of a gear for transmitting driving force to the developing roller more precisely would be helpful.

BRIEF DESCRIPTION OF DRAWINGS

FIG. 4*a* is a diagram illustrating a state in which a developing roller gear, a supply roller gear and a driving input gear are removed and FIG. 4*b* is a diagram illustrating a state in which the developing roller gear, the supply roller gear and the driving input gear are attached.

FIG. 10*a* is a diagram illustrating a supply roller gear and the intermediate gear being meshed between the driving input gear and the developing roller gear, and FIG. 10*b* is a diagram which illustrates the intermediate gear being meshed between the driving input gear and the developing roller gear.

DETAILED DESCRIPTION

Entire Configuration of Laser Printer

Hereinafter, an illustrative embodiment will be described in detail with reference to the drawings. In the following description, a schematic configuration of an image forming apparatus such as a laser printer 1 provided with a developing cartridge 28 according to an illustrative embodiment will be described.

Figure 1:
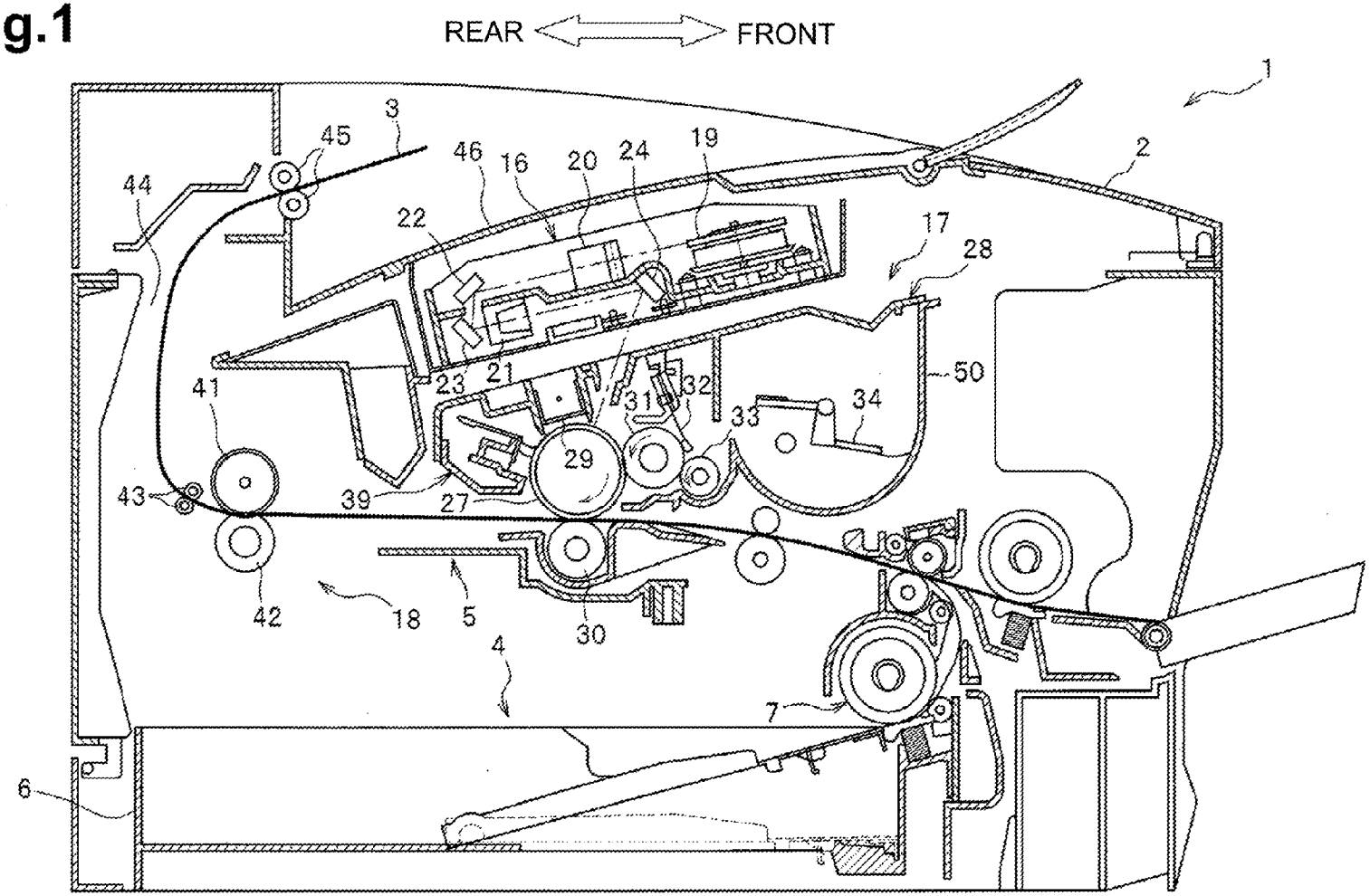
FIG. 1 is a diagram illustrating a schematic configuration of a laser printer which is provided with a developing cartridge according to an illustrative embodiment.

As illustrated in FIG. 1, the laser printer 1 is provided with a feeder unit 4 which supplies a paper sheet 3 to an apparatus main body 2, an image forming unit 5 which forms an image on the supplied paper sheet 3, and the like.

Note that, in the following description, directions are defined with reference to a user who is using the laser printer 1. That is, in FIG. 1, the right side is defined as "front," the left side is defined as "rear," the near side is defined as "left" and the far side is defined as "right." The up and down direction in FIG. 1 is defined as "up and down."

The feeder unit 4 is mainly provided with a paper sheet feeding tray 6 which is attached to a bottom in the apparatus main body 2 in an attachable and detachable manner, and a paper sheet feeding mechanism 7 which conveys the paper sheet 3 from the paper sheet feeding tray 6 to the image forming unit 5. In the feeder unit 4, the paper sheet 3 in the paper sheet feeding tray 6 is fed one at a time by the paper sheet feeding mechanism 7 into the image forming unit 5.

The image forming unit 5 is provided with a scanner unit 16, a process cartridge 17, a fixing device 18 and the like.

The scanner unit 16 is provided in an upper section in the apparatus main body 2. In the scanner unit 16, laser light in accordance with image data is transmitted via a polygon mirror 19, lenses 20 and 21, reflectors 22, 23 and 24, and the like (see the dashed line) and illuminates a surface of the photosensitive drum 27 by high-speed scanning.

The process cartridge 17 is configured to be attached to the apparatus main body 2 in an attachable and detachable manner. This process cartridge 17 includes a developing cartridge 28 and a drum cartridge 39.

The developing cartridge 28 is attachable to and detachable from the apparatus main body 2 in a state in which the developing cartridge 28 is attached to the drum cartridge 39. Note that the developing cartridge 28 may be configured to be attachable to and detachable from the drum cartridge 39 which is fixed to the apparatus main body 2. The developing cartridge 28 is provided with a housing 50, a developing roller 31, a thickness regulating blade 32 and a supply roller 33. Toner is accommodated in the housing 50.

In this developing cartridge 28, the developing roller 31 is supplied with toner accommodated in the housing 50 by the supply roller 33. At this time, the developing cartridge 28 is positively electrified by friction, between the supply roller 33 and the developing roller 31. The toner supplied on the developing roller 31 enters between the thickness regulating blade 32 and the developing roller 31 following rotation of the developing roller 31, and is carried on the developing roller 31 as a thin layer of constant thickness while being electrified by friction. Note that a detailed configuration of the developing cartridge 28 will be described in detail below.

The drum cartridge 39 is mainly provided with a photosensitive drum 27, a scorotron charging unit 29 and a transfer roller 30. In the drum cartridge 39, the surface of the photosensitive drum 27 is uniformly and positively charged by the scorotron charging unit 29 and then is exposed by high-speed scanning of laser light from the scanner unit 16. As a result, the potential of the exposed portion decreases and an electrostatic latent image according to the image data is formed.

Subsequently, the developing roller 31 rotates in contact with the photosensitive drum 27, whereby the electrostatic latent image formed on the surface of photosensitive drum 27 is supplied with the positively-charged toner carried on the surface of the developing roller 31 and a toner image is formed on the surface of the photosensitive drum 27. Then, as the photosensitive drum rotates, the toner image on the photosensitive drum 27 is transferred to the paper sheet 3 by the transfer roller 30 while the paper sheet 3 is conveyed between the photosensitive drum 27 and the transfer roller 30.

The fixing device 18 is provided at the rear side of the process cartridge 17, and is provided with a heat roller 41 and a pressure roller 42 which pressurizes the heat roller 41. In the fixing device 18, while the paper sheet 3 passes between the heat roller 41 and the pressure roller 42, the toner transferred to the paper sheet 3 is heat fixed. The paper sheet 3 which has undergone heat fixing in the fixing device 18 is conveyed to a paper sheet output path 44 by a conveyance roller 43. Then, the paper sheet 3 fed to the paper sheet output path 44 is output on the paper sheet output tray 46 by the output roller 45.

Detailed Configuration of Developing Cartridge

Next, a detailed configuration of the developing cartridge 28 as a feature of the disclosure will be described.

Figure 2:
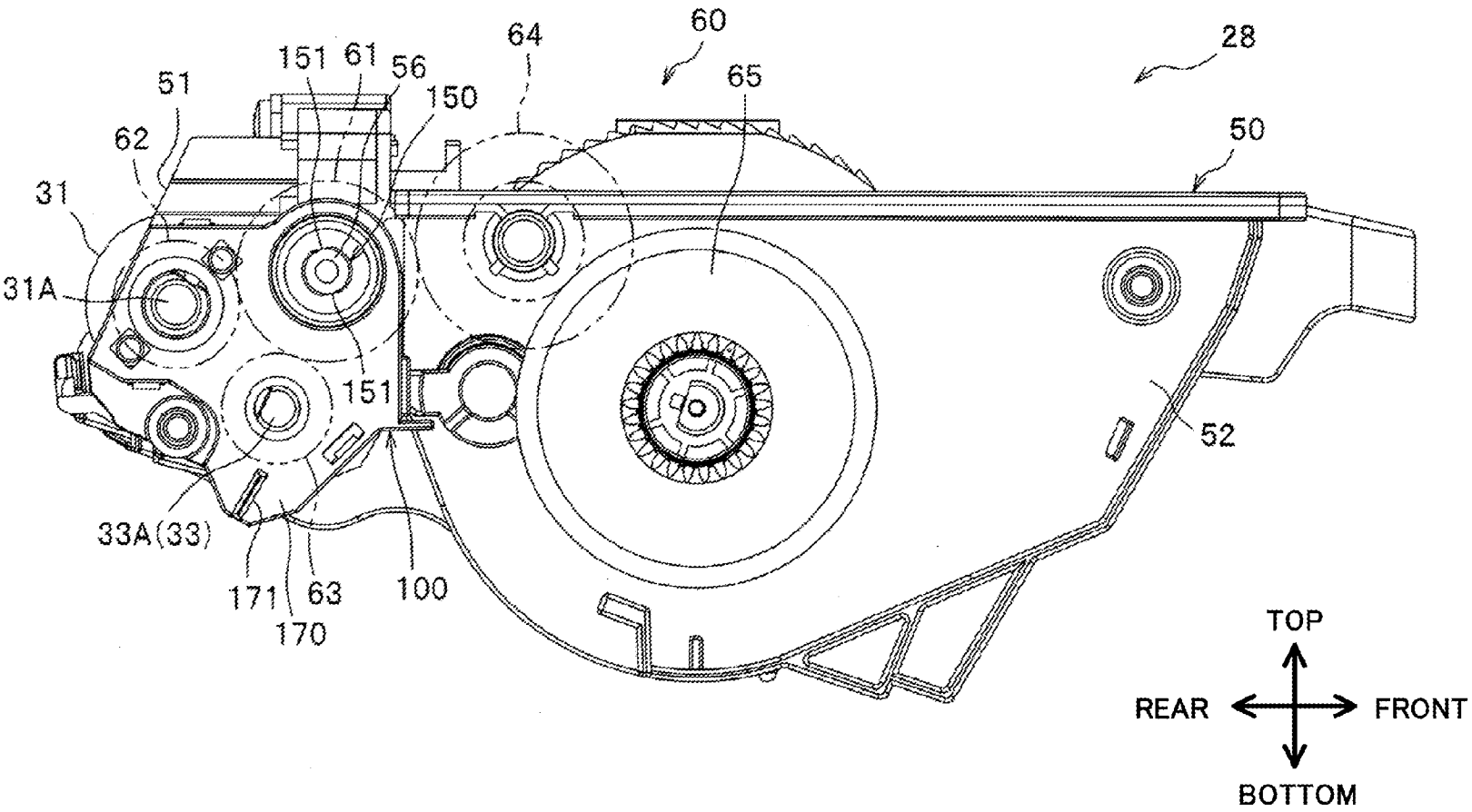
FIG. 2 is a side view illustrating the developing cartridge according to an illustrative embodiment.
Figure 6A:
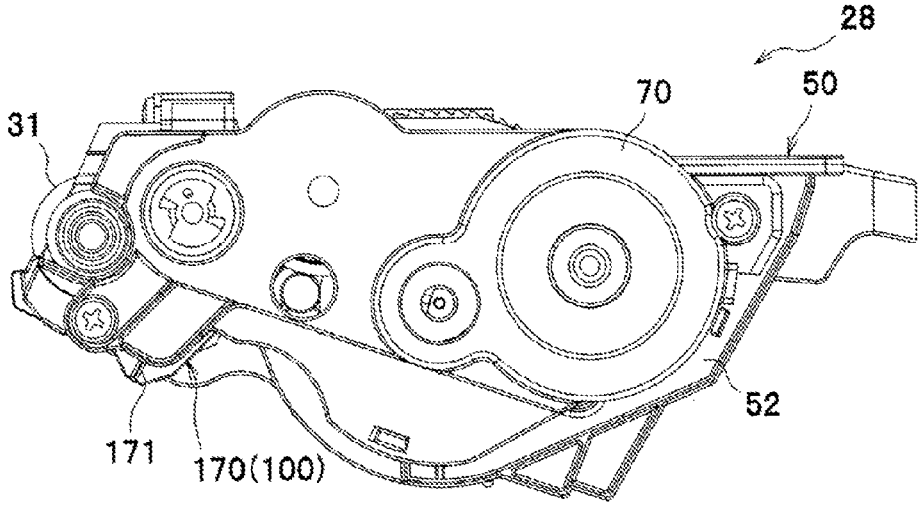
FIG. 6*a* is a side view of the developing cartridge to which a gear cover is attached and FIG. 6*b* is a plan view schematically illustrating a drum cartridge.
Figure 6B:
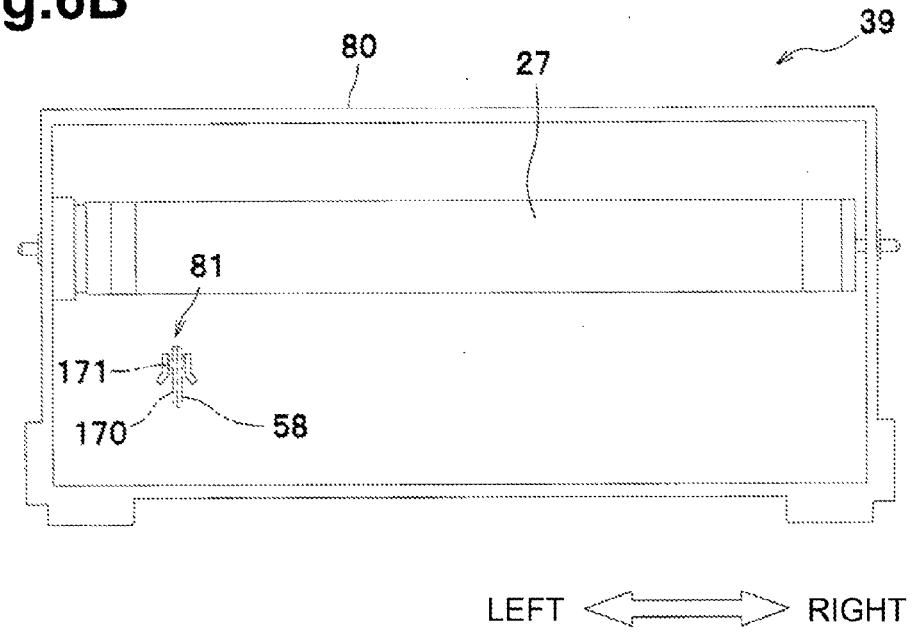

The developing cartridge 28 is provided with, as illustrated in FIGS. 1 and 2, the housing 50, the developing roller 31, the supply roller 33, an agitator 34, a gear train 60, a receiving member 100 and a gear cover 70 which covers the gear train 60 (see FIG. 6(*a*)).

As illustrated in FIG. 2, the developing roller 31 and the supply roller 33 are supported by the housing 50 via the receiving member 100 which will be described below. The housing 50 is made of resin, such as polystyrene. The housing 50 includes a left wall 52 which has an opening 53 at a rear wall 51 side (one side) (see also FIG. 3). The gear train 60 and the receiving member 100 are disposed on the left wall 52. In FIG. 2 and other drawings, the tooth profile of each gear which constitutes the gear train 60 is omitted.

The gear train 60 is a mechanism which applies driving force input from outside to the developing roller 31, the supply roller 33 and the agitator 34. In particular, the gear train 60 in which driving force is input from outside includes the driving input gear 61, a developing roller gear 62 which rotates integrally with the developing roller 31, a supply roller gear 63 which rotates integrally with the supply roller 33, an agitator gear 65 which rotates integrally with the agitator 34 and an idle gear 64 which is meshed with the driving input gear 61 and with the agitator gear 65.

As illustrated in FIG. 2, the driving input gear 61 is directly meshed with the developing roller gear 62 and the supply roller gear 63. The driving input gear 61, the developing roller gear 62 and the supply roller gear 63 are rotatably supported by the receiving member 100.

Figure 3:
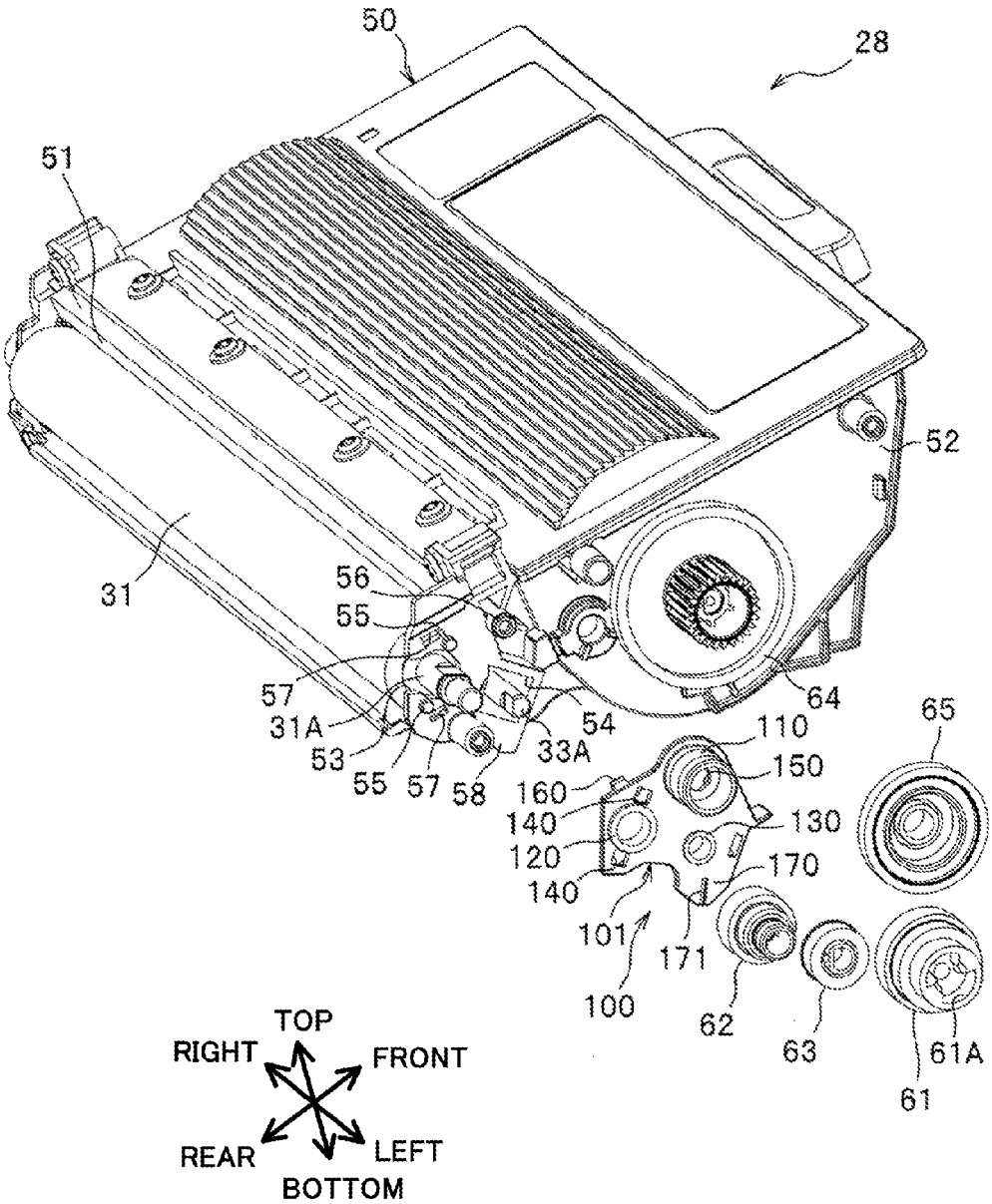
FIG. 3 is an exploded perspective view illustrating a configuration of a left surface of the developing cartridge.

As illustrated in FIG. 3, in the driving input gear 61, an engaging unit, for example, a recess 61A is formed on an outer surface of the developing roller 31 in an axial direction (hereinafter, simply referred to as "axial direction"). This recess 61A is engageable with and disengageable from a driving source M in the axial direction (see FIG. 4(*b*)).

The receiving member 100 is disposed between the housing 50 and the developing roller gear 62, and between the housing 50 and the driving input gear 61. The receiving member 100 mainly includes a plate-shaped receiving member main body 101, a driving input gear support unit 110, a first bearing unit 120 used as a bearing of the developing roller 31, a second bearing unit 130 used as a bearing of the supply roller 33, a first engaged unit such as a pair of first engaging holes 140, a second engaged unit such as a second engaging hole 150, and two claws 160 (see also FIG. 5(*a*)). Note that the receiving member is made of a material which is harder than a material of the housing 50, e.g., polyacetal, from the viewpoint of wear resistance.

Figure 5A:
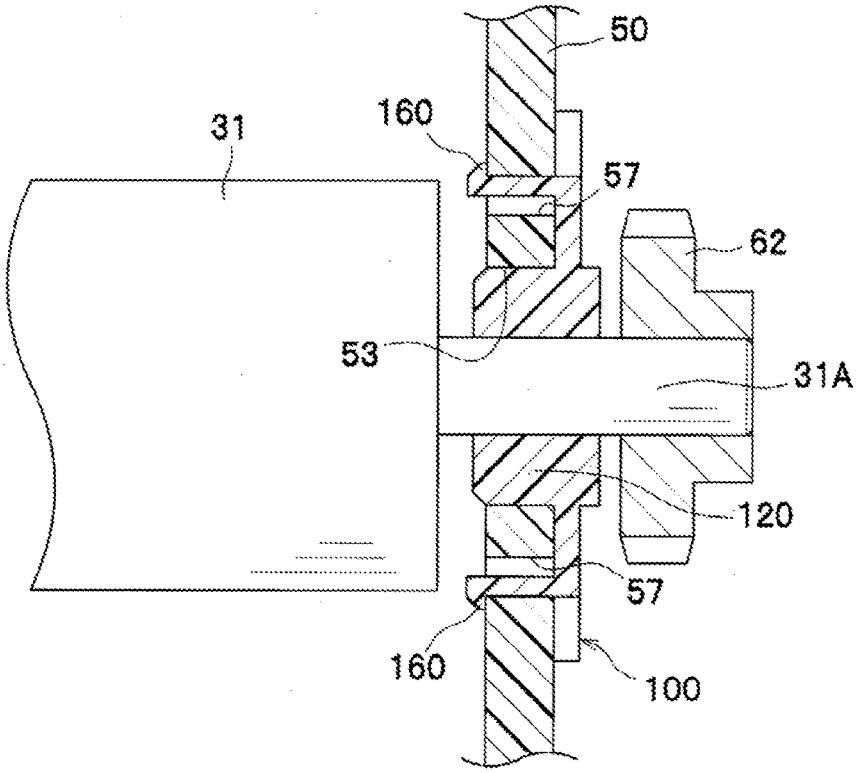
FIG. 5*a* is a sectional view of an area near a first bearing unit of FIG. 4
Figure 5B:
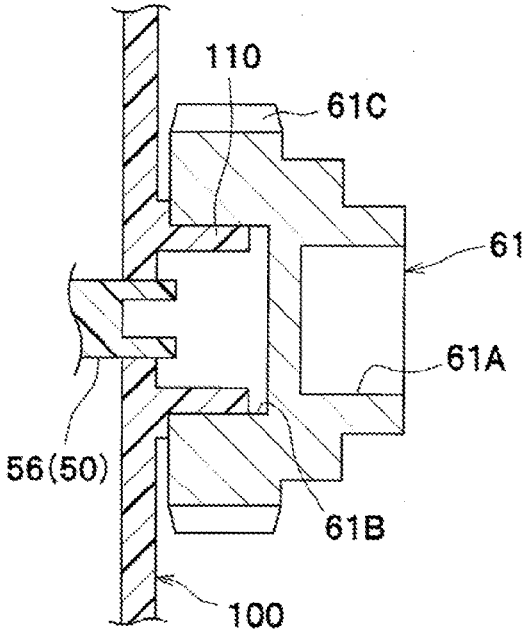
FIG. 5*b* is a sectional view of an area near the driving input gear.

The driving input gear support unit 110 in this illustrative embodiment is a boss which has a cylindrical shape and protrudes in an axial direction of the developing roller 31 away from the receiving member main body 101. As illustrated in FIG. 5(*b*), this driving input gear support unit 110 supports the driving input gear 61 directly and rotatably by engaging a recess 61B formed on a surface which faces the receiving member 100 of the driving input gear 61. The driving input gear support unit 110 is sized to have a length that extends to gear teeth 61C of the driving input gear 61 in the axial direction to prevent misalignment of the position of the gear teeth 61C of the driving input gear 61.

As illustrated in FIG. 3 a first bearing unit 120 is formed to penetrate the receiving member main body 101 in the axial direction at the rear side of the driving input gear support unit 110, and has a cylindrical shape protruding toward the interior of the receiving member main body 101 in the axial direction.

As illustrated in FIG. 3, a second bearing unit 130 is formed to penetrate driving input gear support unit 110 in the axial direction below the driving input gear support unit 110, and has a cylindrical shape projecting toward the interior of the receiving member main body 101 in the axial direction.

First engaging holes 140 are a pair of holes penetrating driving input gear support unit 110 in the axial direction disposed at upper and lower sides of the first bearing unit 120, which sandwich the first bearing unit 120.

The second engaging hole 150 is a hole formed inside the driving input gear support unit 110 when seen in an axial direction. In particular, the second engaging hole 150 has a shape in which a part of a circle is narrowed, as illustrated in FIG. 2. Edges 151 which face each other at the narrowed portion extend in the direction parallel to the direction toward the center of an axis 31A of the developing roller 31 from the center of a second projection 56 which will be described below.

As illustrated in FIG. 5(*a*), two claws 160 are formed at an upper end and a lower end of the receiving member main body 101 to sandwich the first bearing unit 120 from upper and lower sides. The claws 160 extend from the receiving member main body 101 inwardly in the axial direction and have a hook shape projecting outward at ends thereof. The claws 160 have flexibility by extending in an elongated manner from the receiving member main body 101.

The receiving member main body 101 includes a positioning unit 170 projecting downward as illustrated in FIG. 3; and a rib 171 extending in a substantially up and down direction and formed in an axial direction on an outer surface of the positioning unit 170.

Next, a configuration of the housing 50 to which the receiving member 100 above is attached will be described.

The housing 50 includes, at the rear side of the left wall 52, a first opening 53, a second opening 54, a first engaging unit, which in this illustrative embodiment is a pair of first projections 55, a second engaging unit, which in this illustrative embodiment is second projection 56, and two locking holes 57.

The first opening 53 is formed in a substantially C-shape which opens on the side of the rear wall 51 when viewed from a side. The axis 31A of the developing roller 31 is disposed in the first opening 53.

The second opening 54 is formed at a diagonally lower front of the first opening 53. An axis 33A of the supply roller 33 is disposed in the second opening 54.

The first projections 55 are formed to project in an axial direction from the left wall 52, i.e., toward the receiving member 100, at positions to face each other via the first opening 53 in the direction which intersects perpendicularly to an axial direction corresponding to a pair of first engaging holes 140.

In the front of the first opening 53, the second projection 56 is formed to project toward the receiving member 100 from the left wall 52 corresponding to the second engaging hole 150. A diameter of the second projection 56 is substantially the same as the distance between edges 151 of the second engaging hole 150.

Two locking holes 57 are formed at positions to face each other via the first opening 53, and are formed in the housing 50 in an axial direction as illustrated in FIG. 5(*a*).

The left wall 52 of the housing 50 includes an extending portion 58 disposed below the second opening 54. The extending portion 58 extends downward as a plate as illustrated in FIG. 3.

The receiving member 100 is fixed to the housing 50 by the claws 160 engaging the locking holes 57 as illustrated in FIG. 5(*a*). In particular, the claws 160 penetrate the locking holes 57 from outside to inside, and are locked by the edges of the locking hole 57 inside the left wall 52.

Figure 4A:
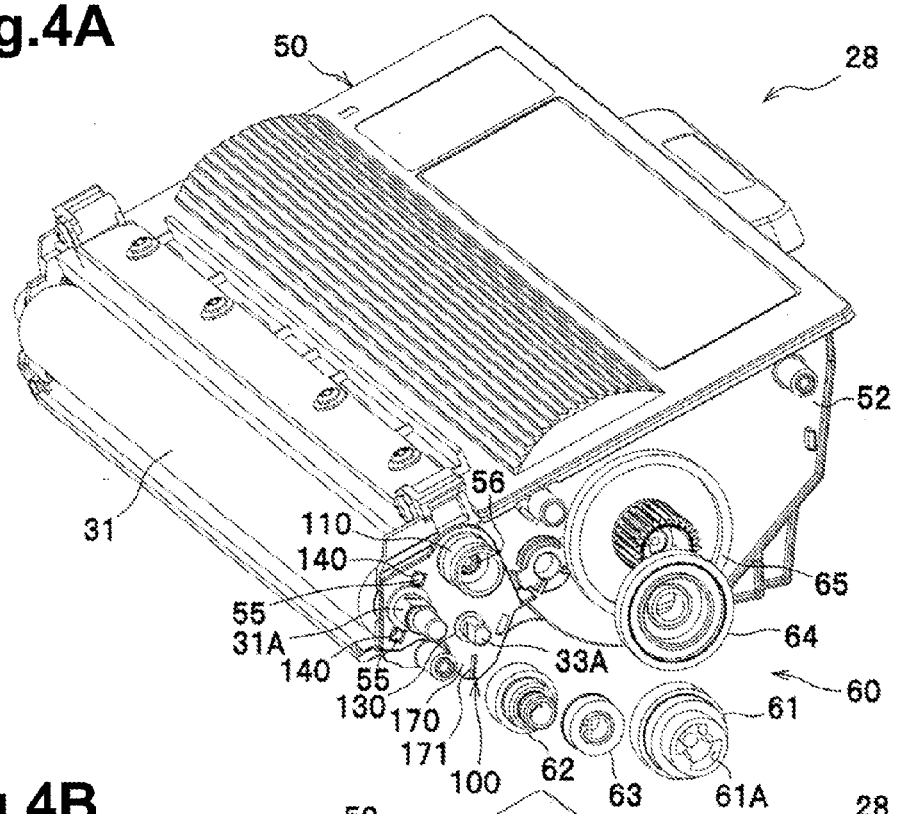
FIGS. 4*a* and 4*b* provide diagrams illustrating a left surface of the developing cartridge.
Figure 4B:
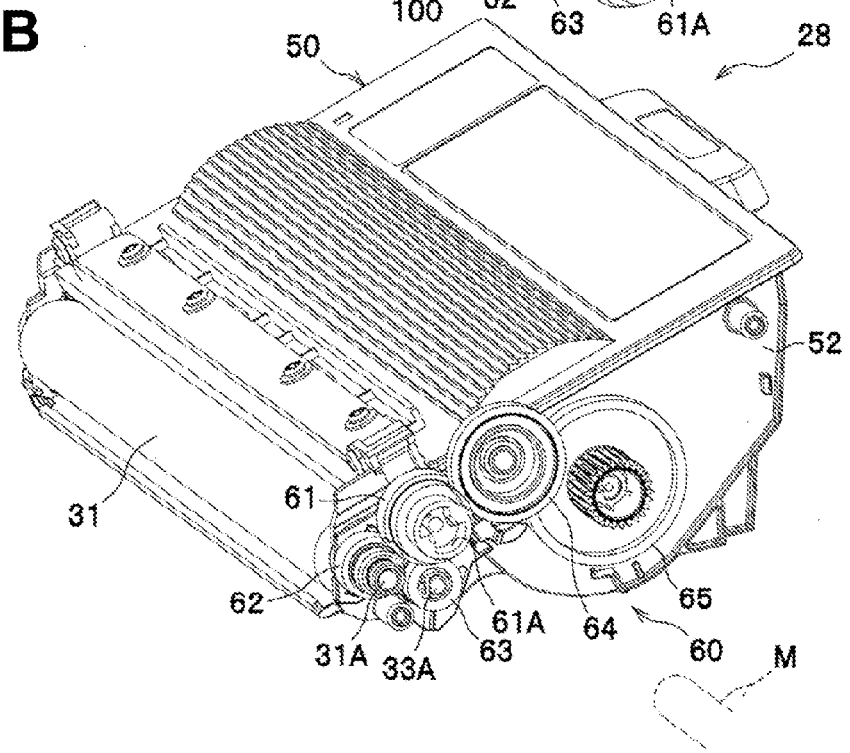

In the first bearing unit 120, a portion protruding from the receiving member main body 101 in an axial direction inside fits in the first opening 53. The first bearing unit 120 supports the axis 31A of the developing roller 31 directly and rotatably. As illustrated in FIG. 4(*a*), the second bearing unit 130 supports the axis 33A of the supply roller 33 directly and rotatably.

The pair of first projections 55 of the housing 50 fits in a pair of first engaging holes 140 of the receiving member 100. The second projection 56 of the housing 50 fits in the second engaging hole 150 of the receiving member 100.

As illustrated in FIG. 4(*b*), with respect to the housing 50 to which the receiving member 100 is attached, the developing roller gear 62 is fixed to a left end of the axis 31A of the developing roller 31, and is rotatably supported by the receiving member 100 via the axis 31A of the developing roller 31. The supply roller gear 63 is fixed to a left end of the axis 33A of the supply roller 33, and is rotatably supported by the receiving member 100 via the axis 33A of the supply roller 33.

The extending portion 58 of the housing 50 overlaps the positioning unit 170 of the receiving member 100 and reinforces the positioning unit 170.

As illustrated in FIG. 6(*a*), the gear cover 70 is a member which covers the gear train 60 and is fixed to the left wall 52 with screws. The gear cover 70 is formed not to overlap the positioning unit 170 of the receiving member 100 when seen in an axial direction. That is, the positioning unit 170 extends outward from below the gear cover 70.

On the other hand, a case body 80 of the drum cartridge 39 to which the developing cartridge 28 is attached includes a groove 81 on the left side of a bottom surface. When the developing cartridge 28 is attached to the drum cartridge 39, the positioning unit 170 is disposed in the groove 81. An urging member (not shown) which urges the developing cartridge 28 to the left is provided in the apparatus main body 2 such that the rib 171 of the positioning unit 170 is in contact with the wall which constitutes the groove 81. An urging member such as an electrode makes contact with a right end of the axis 31A of the developing roller 31 and supplies the developing roller 31 with development bias.

Operations and effects of the developing cartridge 28 configured as described above will be described.

When the driving source M engages the recess 61A of the driving input gear 61 and driving force is applied to the driving input gear 61, the driving input gear 61 is rotated clockwise in FIG. 2. Since the developing roller gear 62 is meshed with the driving input gear 61, driving force is input therein from the driving input gear 61 and the developing roller gear 62 is rotated counterclockwise in FIG. 2. As such, the developing roller 31 is rotated. Since the supply roller gear 63 is meshed with the driving input gear 61, driving force is input therein from the driving input gear 61 and the supply roller gear 63 is rotated counterclockwise in FIG. 2. As such, the supply roller 33 is rotated. Since the idle gear 64 is meshed with the driving input gear 61, the idle gear 64 is rotated counterclockwise in FIG. 2. As such, the agitator gear 65 which is meshed with the idle gear 64 is rotated clockwise in FIG. 2.

Now, unless the distance between axes of gears, such as the developing roller gear 62 and the driving input gear 61 which are meshed with each other, is not determined precisely, uneven rotation of the gears may be caused.

Then, according to this illustrative embodiment, since the developing roller gear 62 and the driving input gear 61 are rotatably supported by the receiving member 100, the distance between the axis of the developing roller gear 62 and the axis of the driving input gear 61 can be determined precisely using a single member between the housing 50 and the developing roller gear 62, and between the housing and the driving input gear 61.

Since the supply roller gear 63 is rotatably supported by the receiving member 100, the distance between an axis of the supply roller gear 63 and the axis of the driving input gear 61 can also be determined precisely by the receiving member 100.

In the receiving member 100, since the driving input gear support unit 110 which rotatably supports the driving input gear 61 is formed as a boss in which the driving input gear 61 fits, space on an inner side of the gear teeth of the driving input gear 61 when seen in an axial view can be used effectively, as compared with a configuration in which the driving input gear 61 includes an axis which projects on the side of the receiving member 100 and is rotatably supported by the receiving member 100. As such, the size of the developing cartridge 28 can be reduced.

Since the driving input gear support unit 110 extends to the gear teeth of the driving input gear 61 in an axial direction, misalignment of the positions of the gear teeth of the driving input gear 61 can be prevented.

Even in a situation in which the first opening 53 is easily opened when the developing roller gear 62 receives driving force from the driving input gear 61, since the pair of first engaging holes 140 of the receiving member 100 engages the pair of first projections 55 which face each other via the first opening 53, the first opening 53 which opens on the side of the rear wall 51 may be prevented from being opened.

Since the second projection 56 fits in the second engaging hole 150, even if the receiving member 100 is to be rotated about the developing roller 31 when the developing roller 31 is rotated, the edges 151 of the second engaging holes 150 abut the second projection 56. As such, rotation of the receiving member 100 can be prevented.

since the second projection 56 and the second engaging hole 150 are provided inside the driving input gear support unit 110 when seen in an axial direction, as compared with a case in which the second projection 56 and the second engaging holes 150 are disposed outside the driving input gear support unit 110, the size of the developing cartridge 28 can be reduced.

Since the portion projecting in an axial direction inside the first bearing unit 120 which is the bearing of the developing roller 31 fits in the first opening 53, the developing roller 31 can be positioned with respect to the housing 50.

Since the positioning unit 170 of the receiving member 100 is in contact with the groove 81 of the drum cartridge 39, the developing cartridge 28 can be positioned with respect to the drum cartridge 39 by the receiving member 100.

A hard material may be used as a member which supports the developing roller 31 and the gear train 60 to reduce wear resistance. The amount of the hard material can be reduced by forming the receiving member 100 with a material harder than the material of the housing 50, which also can reduce cost.

Although an illustrative embodiment has been described, the disclosure is not limited to the same. The specific configuration may be changed suitably without departing from the scope of the disclosure.

Figure 7:
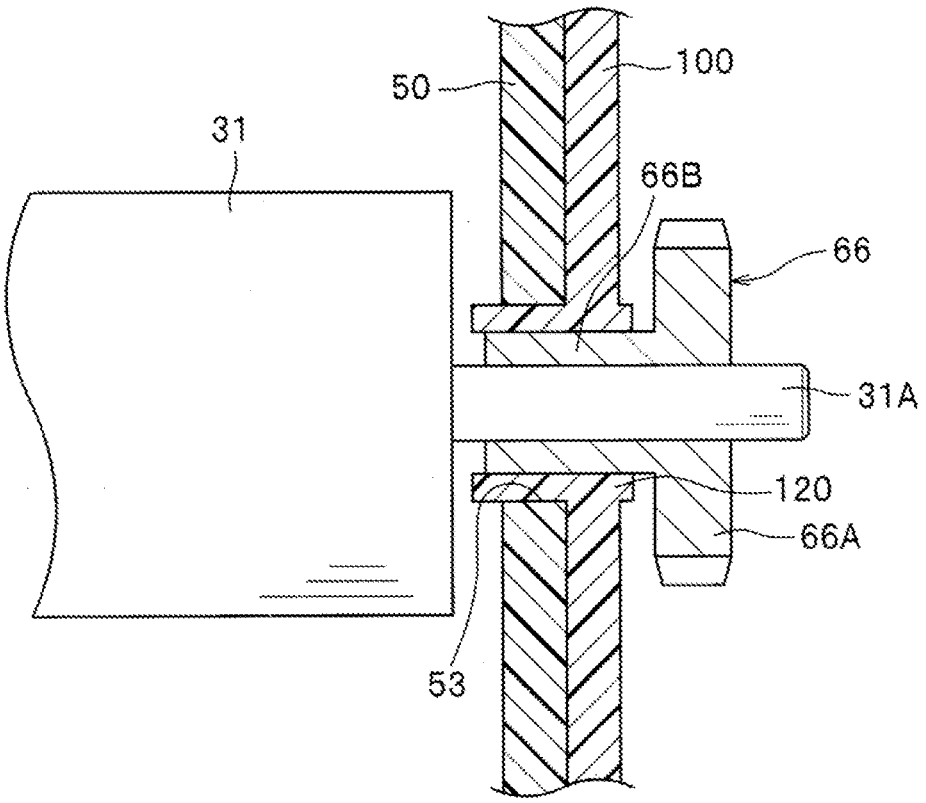
FIG. 7 is a sectional view illustrating an area near a left end of the developing roller in a developing cartridge according to another illustrative embodiment.

In the above-described illustrative embodiment, although the developing roller gear 62 is rotatably supported by the receiving member 100 via the axis 31A of the developing roller 31, the disclosure is not limited to the same. For example, as illustrated in FIG. 7, a developing roller gear 66 may be supported directly and rotatably by the receiving member 100.

In particular, the developing roller gear 66 includes a gear unit 66A which is provided with gear teeth on an outer peripheral surface, and a portion to be supported 66B extending in an axial direction inside, i.e., toward the receiving member 100, from the gear unit 66A. The portion to be supported 66B is disposed in the first bearing unit 120 of the receiving member 100, and is supported by the receiving member 100 directly and rotatably.

Figure 8A:
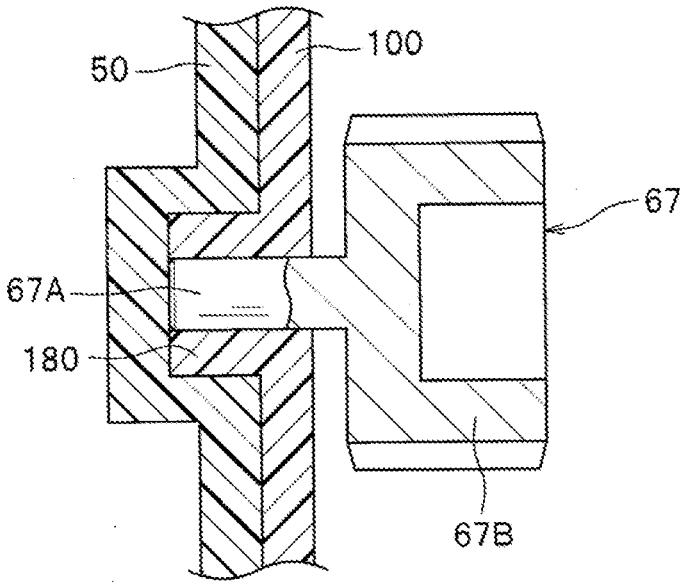
FIG. 8*a* is a diagram illustrating a case in which a driving input gear according to a second illustrative embodiment is directly supported by a receiving member and FIG. 8*b* is a diagram illustrating a state in which a driving input gear according to a third illustrative embodiment is supported by a receiving member via a shaft.
Figure 8B:
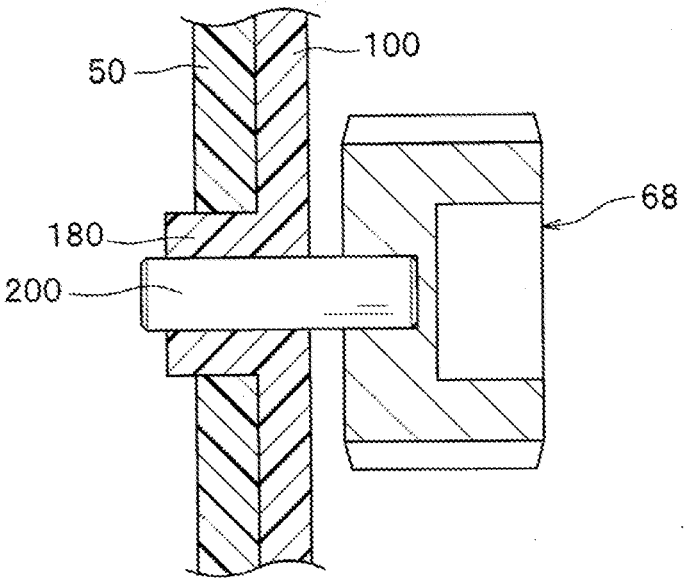

Although the driving input gear 61 is supported by the receiving member 100 by the boss-shaped driving input gear support unit 110 which projects in an axial direction outside the receiving member 100 engaging the recess 61B formed in the driving input gear 61 in the above-described illustrative embodiment, the disclosure is not limited to this. For example, as illustrated in FIG. 8(*a*), the driving input gear 67 may include an integral axis 67A extending in an axial direction inside from the gear unit 67B, and may be supported by the driving input gear support unit 180 by the axis 67A being engaged with the driving input gear support unit 180 which is formed in the receiving member 100.

In the above-described illustrative embodiment, although the driving input gear 61 is directly supported by the receiving member 100, the disclosure is not limited to the same. For example, as illustrated in FIG. 8(*b*), the driving input gear 68 may be supported by the receiving member 100 via the shaft 200. In particular, the driving input gear 68 is fixed to the shaft 200 and is rotated integrally with the shaft 200. And the driving input gear support unit 180 is formed in the receiving member 100. The shaft 200 is rotatably supported by this driving input gear support unit 180.

Thus, in a case in which the driving input gear 61 is supported by the receiving member 100 via the shaft 200, the distance between an axis of the driving input gear 61 and an axis of the developing roller gear 62 can be determined precisely.

Figure 9:
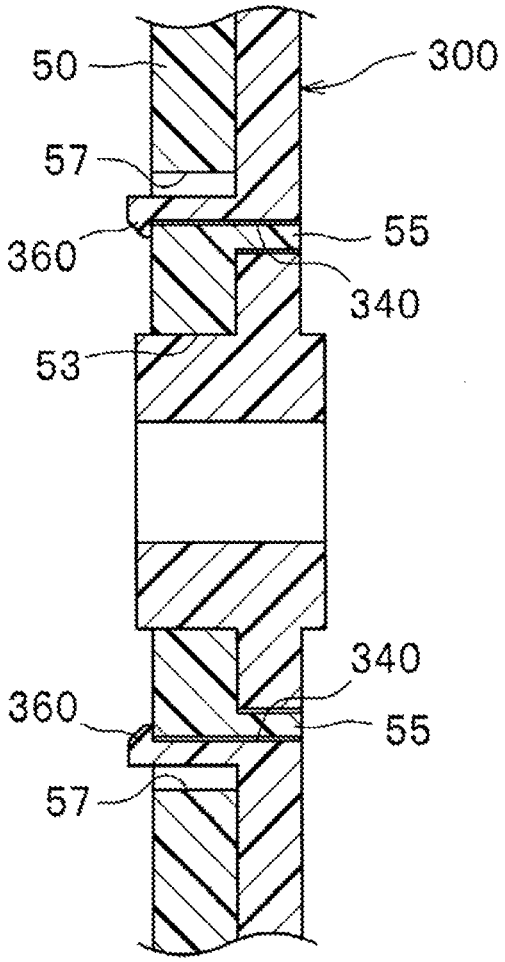
FIG. 9 is a diagram illustrating another illustrative embodiment of a receiving member and is a sectional view illustrating a claw of the receiving member.

Although in the above-described illustrative embodiment the first engaging hole 140 is molded separately from the claw 160, a hole formed at the time of molding the claw 160 may serve as the first unit to be engaged. For example, as illustrated in FIG. 9, a hole 340 formed at the base portion of the claw 360 for molding the claw 360 is formed in the receiving member 300. This hole 340 is the first unit to be engaged which engages the first projection 55 formed in the housing 50. According to this example, a simple molding die can be used and the size of the developing cartridge 28 can be reduced.

In the above-described illustrative embodiment, although the driving input gear 61 is meshed with the developing roller gear 62, the disclosure is not so limited. For example, driving force of the driving input gear 61 may be applied to the developing roller gear 62 by at least one intermediate gear which is rotatably supported by the receiving member 100 and is meshed with the developing roller gear 62 and with the driving input gear 61.

Figure 10A:
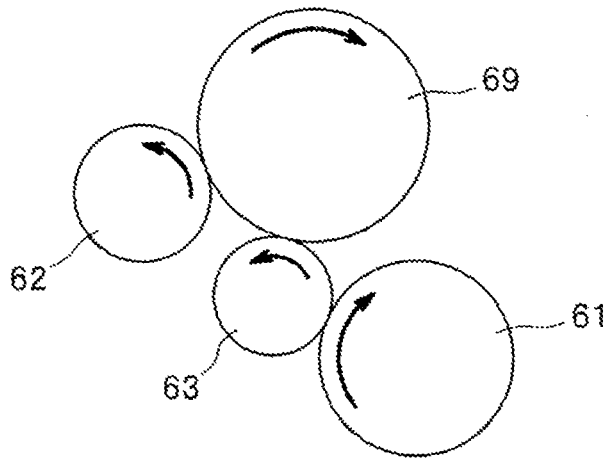
FIGS. 10*a* and 10*b* provide an illustrative modification with an intermediate gear which is meshed with a driving input gear and a developing roller gear.
Figure 10B:
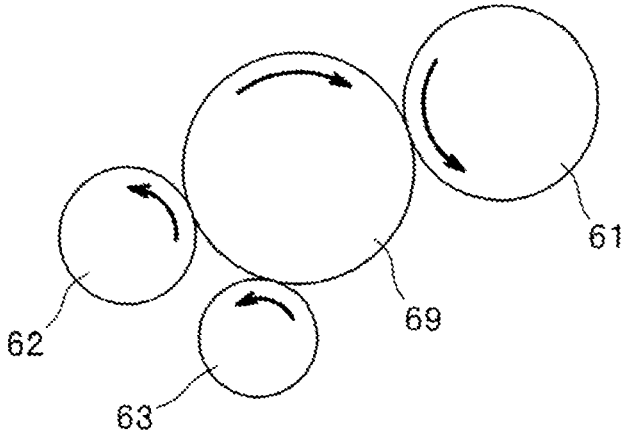

In particular, an example of such a form will be described. As illustrated in FIG. 10(*a*), the supply roller gear 63 and the intermediate gear 69 are rotatably supported by the receiving member 100 between the developing roller gear 62 and the driving input gear 61. The supply roller gear 63 is meshed with the driving input gear 61. The intermediate gear 69 is meshed with the supply roller gear 63 and with the developing roller gear 62.

With the configuration described above, the distance between the axis of the driving input gear 61 and an axis of the supply roller gear 63, the distance between the axis of the supply roller gear 63 and an axis of the intermediate gear 69, and the distance between the axis of the intermediate gear 69 and the axis of the developing roller gear 62 can be determined precisely.

As another modification, driving force of the driving input gear 61 may be applied to the developing roller gear 62 by the intermediate gear 69 which is meshed with the driving input gear 61, the developing roller gear 62 and the supply roller gear 63, and is rotatably supported by the receiving member 100 as illustrated in FIG. 10(*b*).

Although the driving input gear support unit 110 is formed to have a length that extends to the gear teeth 61C of the driving input gear 61 in an axial direction in the above-described illustrative embodiment, the driving input gear support unit 110 may be formed to extend across the entire range of the gear teeth 61C in an axial direction.

Although the first engaging unit is a projection and the first engaged unit is a hole in the above-described illustrative embodiment, the disclosure is not so limited. The first engaging unit may be a hole and the first engaged unit may be a projection. As another modification, the first engaging unit may include a hole and a projection. In this modification, the first engaged unit may then include a projection corresponding to the hole of the first engaging unit and a hole corresponding to the projection of the first engaging unit.

Although the second projection 56 and the second engaging hole 150 are provided inside the driving input gear support unit 110 when seen in an axial direction in the above-described illustrative embodiment, the disclosure is not so limited. The second projection 56 and the second engaging hole 150 may be provided outside the driving input gear support unit 110 in an axial direction.

Although the drum cartridge 39 has been described as the device to which the developing cartridge 28 is attached in the above-described illustrative embodiment, the disclosure is not limited to the same. For example, the device to which the developing cartridge 28 is attached may be the laser printer 1.

Although the disclosure is applied to the laser printer 1 in the above-described illustrative embodiment, the disclosure is not limited to the same. The disclosure may also be applied to other image forming apparatuses, such as a copying device and a multi-function device.

The invention claimed is:

1. A developing cartridge comprising:

a housing including a wall;

a developing roller rotatably provided in the housing, the developing roller having a shaft;

a developing roller gear fixed to the shaft of the developing roller and configured to rotate integrally with the developing roller;

a supply roller rotatably provided in the housing, the supply roller having a shaft;

a supply roller gear fixed to the shaft of the supply roller and configured to rotate integrally with the supply roller;

a driving input gear configured to receive an external driving force, the driving input gear being meshed with the developing roller gear and the supply roller gear, the driving input gear configured to apply the received driving force to the developing roller gear and the supply roller gear; and a receiving member which is disposed between the housing and the developing roller gear, between the housing and the supply roller gear and between the housing and the driving input gear, the receiving member having a first bearing unit supporting the shaft of the developing roller, a second bearing unit supporting the shaft of the supply roller and a driving input gear support unit supporting the driving input gear, wherein the wall of the housing includes:

an opening in which the shaft of the developing roller is disposed, first projections projecting outwardly in an axial direction along the shaft of the developing roller, the first projections provided at positions that face each other across the opening in a direction which is perpendicular to the axial direction, and locking holes provided at positions that face each other across the opening in a direction which is perpendicular to the axial direction, wherein the receiving member includes:

claws extending inwardly in the axial direction and having a hook shape, the claws configured to engage with the locking holes, and the first bearing unit disposed between the claws, and first engaging holes configured to engage with the first projections, the first bearing unit disposed between the first engaging holes, wherein the driving input gear support unit includes a boss which protrudes in the axial direction away from the housing and rotatably supports the driving input gear.

2. The developing cartridge according to claim 1, wherein the boss extends to gear teeth of the driving input gear in the axial direction.

3. The developing cartridge according to claim 1, wherein:

the housing includes an engaging unit; and the receiving member includes, inside the boss in the axial direction, an engaged unit configured to engage the engaging unit.

4. The developing cartridge according to claim 1, wherein the first bearing unit has a protruding portion protruding toward the housing in the axial direction and the protruding portion fits in the opening.

5. The developing cartridge according claim 1, wherein, in the receiving member, a positioning unit extends away from the housing in a direction perpendicular to the axial direction and is configured to contact an apparatus to which the developing cartridge is configured to be attached, and to set a position of the developing cartridge in the axial direction with respect to the apparatus.

6. The developing cartridge according to claim 1, wherein the receiving member is composed of a material which is harder than a material of the housing.

7. The developing cartridge according to claim 1, wherein the driving input gear includes an engaging unit which is engageable with and disengageable from a driving source in the axial direction.

* * * * *